US008316476B2

(12) United States Patent
Gardenier

(10) Patent No.: US 8,316,476 B2
(45) Date of Patent: Nov. 27, 2012

(54) HOT TUB AND STRADDLE CHAIR APPARATUS

(75) Inventor: W. John Gardenier, Wallingford, CT (US)

(73) Assignee: Thermospas Hot Tub Products, Inc., Wallingford, CT (US)

( * ) Notice: Subject to any disclaimer, the term of this patent is extended or adjusted under 35 U.S.C. 154(b) by 1175 days.

(21) Appl. No.: 12/100,589

(22) Filed: Apr. 10, 2008

(65) Prior Publication Data

US 2009/0255048 A1 Oct. 15, 2009

(51) Int. Cl.
*A47K 3/00* (2006.01)

(52) U.S. Cl. ..... 4/541.1; 4/579

(58) Field of Classification Search ..... 5/541.1, 5/562.1, 578.1, 579; D23/280.1
See application file for complete search history.

(56) References Cited

U.S. PATENT DOCUMENTS

| | | | | | |
|---|---|---|---|---|---|
| 1,240,479 | A | | 9/1917 | Nichols | |
| 1,245,660 | A | * | 11/1917 | Behm | 4/579 |
| 2,112,662 | A | * | 3/1938 | Bentz | 4/579 |
| 3,166,282 | A | | 1/1965 | Nolan | |
| 4,839,930 | A | * | 6/1989 | Watkins | 601/148 |
| D321,244 | S | * | 10/1991 | Delepine | D23/280.1 |
| 5,129,112 | A | | 7/1992 | Schaffer | |
| 5,172,433 | A | * | 12/1992 | Lake | 4/541.4 |
| 5,333,324 | A | * | 8/1994 | Pinciaro | 4/567 |
| 5,682,625 | A | | 11/1997 | Leaverton | |
| 5,716,333 | A | | 2/1998 | Larsen | |
| 5,928,171 | A | | 7/1999 | Larsen | |
| 6,094,795 | A | | 8/2000 | Davenport | |
| 6,339,853 | B1 | | 1/2002 | Apostolo | |
| 7,055,187 | B1 | | 6/2006 | Fields | |
| 7,310,835 | B2 | | 12/2007 | Walker | |
| 2004/0177438 | A1 | | 9/2004 | Gruenwald et al. | |
| 2007/0289057 | A1 | * | 12/2007 | Ludlow | 4/541.6 |

FOREIGN PATENT DOCUMENTS

| | | |
|---|---|---|
| EP | 864285 A2 | 9/1998 |
| EP | 864285 A3 | 3/1999 |
| GB | 2374531 | 10/2002 |

* cited by examiner

*Primary Examiner* — Korie H. Chan
(74) *Attorney, Agent, or Firm* — The Webb Law Firm

(57) ABSTRACT

A hot tub including a straddle chair that allows a user to comfortably sit within the hot tub in a variety of positions while receiving a water massage to various parts of the user's body. The tub includes a floor, an interior, a sidewall projecting upward relative to the floor, an upper rim around the upper perimeter of the tub, a plurality of seats along the sidewall of the tub, the straddle chair, and a hydrotherapy system for applying a water massage to users sitting in the straddle chair and the plurality of seats. The straddle chair has a back support and a straddle seat. The back support protrudes outward from the sidewall to create space between the straddle seat and the sidewall and between the straddle seat and the other seats in the tub, which allows the user to sit in the straddle chair in a wide range of positions and receive a water massage without contacting other seats or users in the tub.

21 Claims, 6 Drawing Sheets

HOT TUB AND STRADDLE CHAIR APPARATUS

BACKGROUND OF THE INVENTION

1. Field of the Invention

This invention relates broadly to hot tubs. More particularly, this invention relates to a hot tub having a particular seating configuration.

2. State of the Art

Hot tubs are frequently used for relaxation, physical therapy, personal enjoyment, and for social occasions. One of the appealing attributes of hot tubs is that they usually include jets that direct warm pressurized water toward an interior portion of the tub. Water that exits the jets and strikes the user's skin or joints can create a kneading sensation or water massage that is pleasurable, and even rehabilitative. The use of water to treat pain and musculoskeletal disorders, a field known in the art as hydrotherapy, has been in use for many years. Whether for hydrotherapeutic purposes or for personal enjoyment, users of hot tubs frequently position themselves directly in front of the jets of the hot tub to maximize the water pressure on various parts of the their bodies. Hot tub jets are typically recessed within the seats and sidewalls around the tub. Therefore, the specific seating configuration of a hot tub determines whether a user can position a given portion of his body in front of the jets while sitting in the tub.

Standard hot tubs are constructed to accommodate multiple people. The tubs typically provide seating that runs along the sidewall around the tub, which permits users to face each other in the tub while sitting with their legs extending either toward the interior of the tub or along the sidewall. The seating is generally in the form of either a continuous elevated bench-like surface above the floor of the tub, or a surface indentation extending into the sidewall at the corners of the tub. Such seating arrangements attempt to maximize the seating capacity in the tub. Hot tub seats known in the art also generally have fixed heights relative to the floor of the tub. Seating in hot tubs having fixed orientations and heights relative to the floor limits the range of sitting positions therein, and by extension, the portions of the body that a user can place in front of the jets while sitting in the tub.

SUMMARY OF THE INVENTION

The present invention is directed to a hot tub containing a straddle chair that allows a user to comfortably sit within the hot tub in a wide range of positions. The tub has a floor, an interior, a sidewall projecting upward relative to the floor, an upper rim above the sidewall, and a plurality of seats and the straddle chair along the sidewall. The straddle chair includes a back support protruding outward from a portion of the sidewall, and a straddle seat projecting outward from a front face of the back support. The straddle seat is mechanically coupled to the front face of the back support, and in embodiments, is adjustable in height relative to the floor of the tub. A hydrotherapy system is integrated into the tub and adapted to circulate, pressurize, and direct water toward the user sitting in the straddle chair and leaning against the back support. The hydrotherapy system has a first plurality of jets recessed within the back support of the straddle chair, including the front face and opposing side surfaces, a water pump that forces the water through the first plurality of jets and the front face of the back support towards the interior of the tub, and a suction return operably disposed on or near the floor of the tub that returns water to the pump. The wide range of sitting positions in the straddle chair and the ability to adjust the straddle seat's height relative to the floor of the tub gives the user the ability to direct water from the hydrotherapy system towards virtually any part of the user's body.

The back support and straddle seat of the straddle chair are positioned in the tub to provide room for the user's legs and feet in a variety of sitting positions. For example, a user may sit in the straddle chair in (i) a first position wherein the user's back is against the back support and the user's legs extend beyond the front face of the straddle seat toward the interior of the tub in order to receive a water massage to the user's back, (ii) a second position wherein the user's chest is against the back support and the user's legs straddle the back support with the user's thighs extending toward the sidewall of the tub in order to receive a water massage to the user's chest, and (iii) a third position wherein the user's side is against the back support and the user's thighs extend toward side portions of the tub in order to receive a water massage to the user's side. The user may sit in the straddle chair in any of these three positions, or numerous other positions within a nearly three hundred and sixty degree rotation about the straddle seat, with sufficient leg room to avert contacting the sidewall of the tub, the plurality of seats along the sidewall, or any other users sitting in the plurality of seats along the sidewall. The floor of the tub preferably surrounds the straddle chair on at least three sides to support the user's feet in any sitting position.

In the preferred embodiment, the front face of the back support extends from an upper portion of the sidewall down to the floor at an angle. The back support is integrally formed with the sidewall of the tub and preferably has two opposing side surfaces bounded by the floor, the front face, and the sidewall. The front face and two opposing side surfaces together form an outer periphery of the back support of the straddle chair. The straddle seat is separately attached to the back support. It may be permanently mounted, detachably mounted, or slidably coupled to the back support. In embodiments in which the straddle seat is slidably coupled to the back support, the seat's height may be adjustable via a hydraulic mechanism, which allows elderly or injured users to more easily enter and exit the tub.

In one embodiment, both the back support and the straddle seat are integrally formed with the sidewall. In another embodiment, the back support is utilized without the straddle seat, which allows the user to either kneel on the floor of the tub while leaning forward with the user's chest against the back support. In this position, the user has sufficient leg room in the tub to avert contacting the sidewall, the other seats in the tub along the sidewall, or any other users sitting in the seats along the sidewall.

DETAILED DESCRIPTION OF THE PREFERRED EMBODIMENTS

Figure 1:
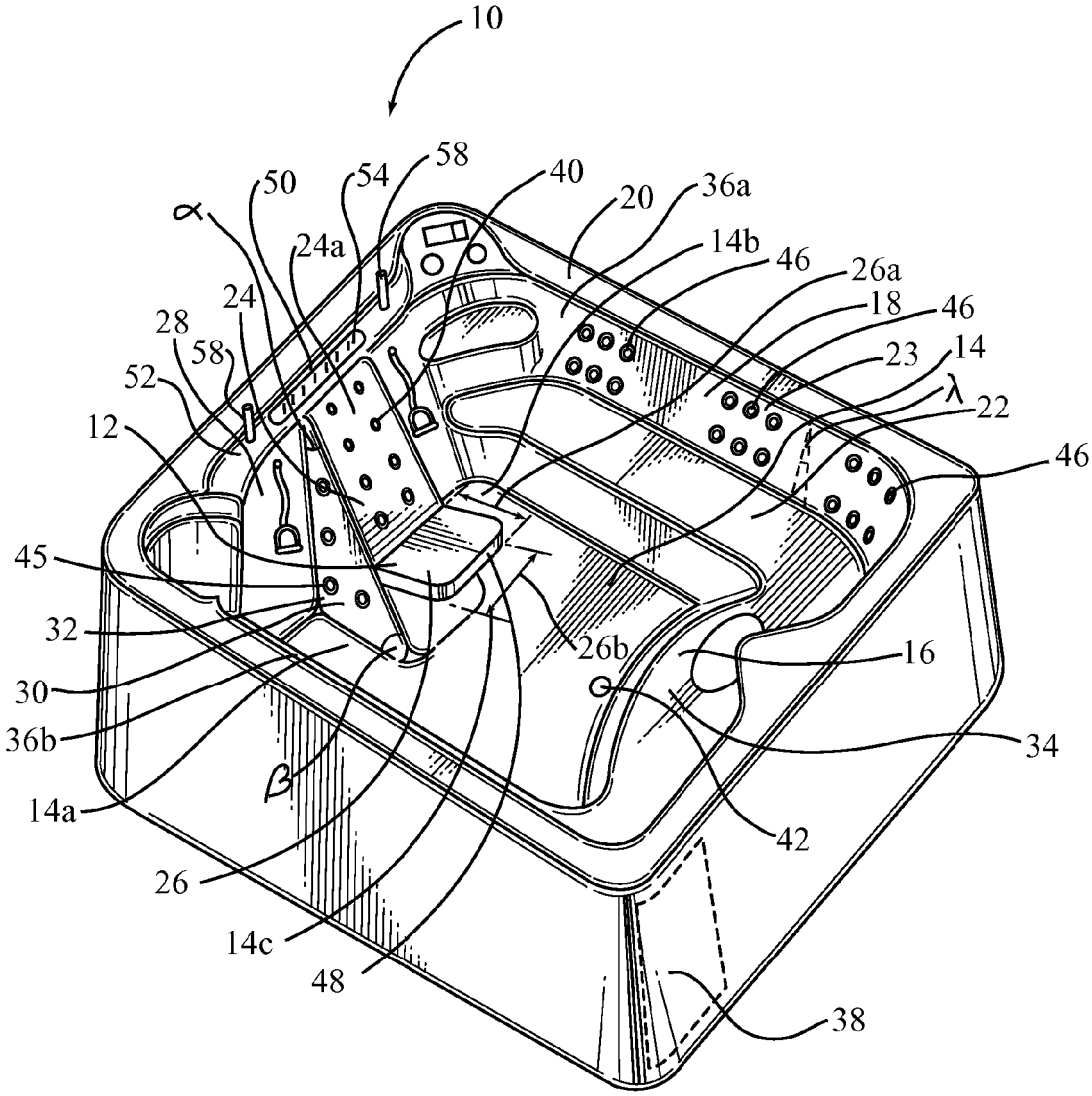
FIG. 1 is a perspective view of a first embodiment of the hot tub and straddle chair of the present invention with the straddle seat of the straddle chair in a lowered position.

Turning to FIG. 1, shown is a hot tub 10 with a straddle chair 12 that allows a user to comfortably sit within the hot tub 10 while facing any portion of the hot tub 10. The hot tub 10 has a floor 14, an interior 16, a sidewall 18 projecting upward relative to the floor 14, an upper rim 20 above the sidewall 18, and a plurality of seats 22 along the sidewall 18. The straddle chair 12 includes a back support 24 and a straddle seat 26. The back support 24 protrudes outward from the sidewall 18 to a front face 24*a*. The straddle seat 26 projects outward from the front face 24*a* of the back support 24 toward the interior 16 of the tub 10. The straddle seat 26 is mechanically coupled in a cantilevered manner relative to the back support 24 and is preferably adjustable in height relative to the floor 14 of the tub 10. The straddle seat 26 may bolt into the front face 24*a* of the back support 24, attach via a snap fit, hook onto support members built into, behind, or protruding from the front face 24*a*, or hook into the back support 24 via an interference fit. The lengthwise dimension 26*a* of the straddle seat 26 may vary depending on the materials used for construction and the means by which it is attached to the back support 24, but is preferably in the range of twelve to fifteen inches. The width 26*b* of the straddle seat 26 may also vary, but is preferably in the range of twelve to eighteen inches. The top of the straddle seat 26 is preferably planar, but may take on a variety of shapes for aesthetic or comfort purposes.

In the preferred embodiment, the front face 24*a* of the back support 24 is generally planar and extends from an upper portion 28 of the sidewall 18 down to the floor 14 at an angle $\alpha=30°\pm5°$, and up relative to the floor at an angle $\beta=60°\pm5°$. The back support 24 is preferably integrally formed with the sidewall 18 of the tub 10, and has two opposing side surfaces 30 bounded by the floor 14, the front face 24*a*, and the sidewall 18. The front face 24*a* and the two opposing side surfaces 30 together form an outer periphery 32 of the back support 24 of the straddle chair 12.

A hydrotherapy system is provided for circulating, pressurizing, and directing water toward the user sitting in the straddle chair 12. By way of example, a hydrotherapy system is disclosed in U.S. Pat. No. 6,094,795, which is herein incorporated by reference in its entirety. A hydrotherapy water massage is provided to a user sitting in the straddle chair 12 as well as the other seats 22 in the tub 10. The hydrotherapy system includes a first plurality of jets 40 situated within the back support 24 of the straddle chair 12, a water pump 38 that pressurizes the water and directs it through the first plurality of jets 40 towards the interior 16 of the tub 10, and a suction return 42, preferably mounted in the floor 14 of the tub 10, that returns water to the pump 38. The first plurality of jets 40 are preferably mounted within the front face 24*a* of the back support 24. The first plurality of jets 40 may be arranged in any formation about the back support, but are preferably adapted to provide full coverage to a user's torso with the straddle seat 16 in the lowered position. The jets 40 may also be adjusted to modify the amount and direction of pressurized water flowing therethrough. A second plurality of jets 45 is likewise provided in opposing side surfaces 30 of the back support 24. Additional pluralities of jets 46 are disposed in the backs of the other plurality of seats 22 for other users in the tub 10. Backs 23 of seats 22 are preferably oriented down from the upper rim 20 at an angle $\lambda$ relative to the vertical such that $\lambda<\alpha$.

The back support 24 and straddle seat 26 of the straddle chair 12 are positioned in the tub 10 to provide room for a user's legs and feet in a variety of sitting positions. For example, in a first position, a user may sit in the straddle chair 12 facing an opposing portion 34 of the tub 10 with his back against the front face 24*a* of the back support 24 and his legs extending towards the opposing portion 34 of the tub 10. Sitting in the first position, the user can easily speak with other people in the tub 10 sitting in the plurality of seats 22 disposed along the sidewall 18 while the user reclines in the straddle chair 12 and receives a water massage on his back. The user may also sit in the straddle chair 12 in a second position with his chest against the back support 24 and his legs straddling the back support 24 in order to receive a water massage on his chest and the inside of his legs. In this position, the user faces the upper portion 28 of the sidewall 18 where the back support 24 extends outward toward the interior 16 of the tub 10. In the second position, the user's legs are disposed on opposite sides of the back support 24 with his thighs extending toward the sidewall 18 of the tub. The user's feet are optionally supported by side portions of the floor 14*a*, 14*b* on opposite sides of the back support 24. In some embodiments, the floor 14 may be elevated at various sections depending on the highest desired height of the straddle seat 26 relative to the floor 14. It is not necessary that the user's feet touch the floor 14, but such a configuration is preferred. The user may also sit in the straddle chair 12 in a third position with his side against the back support 24, his thighs extending toward either side portion 36*a*, 36*b* of the tub 10 and his feet supported by the portions of floor 14*a*, 14*b* on opposite sides of the back support 24. This position allows the user to receive a water massage on a side of his torso while sitting in the straddle chair 12.

The first, second, and third positions described above are merely examples of the potential positions in which a user may sit in the straddle chair 12. The straddle chair 12, by virtue of protruding outward from the sidewall 18, creates space between the straddle seat 26 and the sidewall 18, and, but for the back support 24, allows for a nearly three hundred and sixty degree range of motion of the user (e.g. the user can rotate his/her body in the straddle chair 12 and position himself to face any portion of the tub 10 without standing up). The space between the straddle seat 26 and the sidewall 18 and the space between the straddle seat 26 and the plurality of seats 22 around the tub 10 allows the user to turn from side to side or rotate while sitting in the straddle seat 26 while avoiding contact with the sidewall 18, the plurality of seats 22, or any other users sitting in the plurality of seats 22. While the spacing between the straddle chair and the floor 14, sidewall 18, and plurality of seats 22 may vary, the straddle chair 12 is preferably positioned in the tub 10 such that the opposing side surfaces 30 of the straddle chair 12 are at least five inches from the plurality of seats 22 disposed around the tub 10, and the back support 24 of the straddle chair 12 is at least ten inches from the sidewall 18 at the floor 14 of the tub 10. The floor 14 of the tub 10 preferably surrounds the straddle chair 12 on at least three sides 14*a*, 14*b*, 14*c* to support the user's feet in any sitting position.

Figure 2:
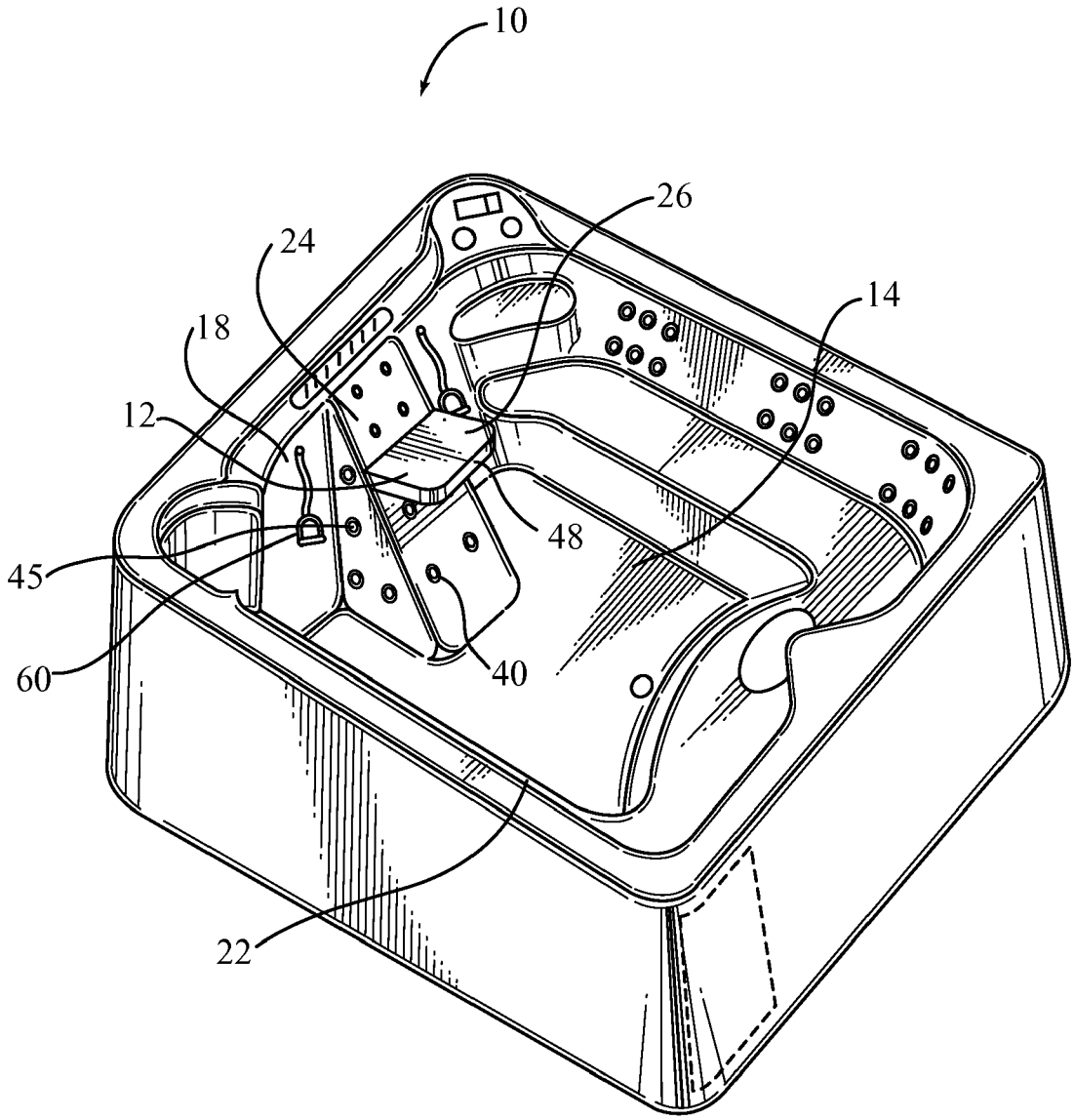
FIG. 2 is a perspective view of a hot tub similar to the hot tub of FIG. 1 with the straddle seat of the straddle chair in a raised position.

It is contemplated that the wide range of sitting positions in the straddle chair 12 discussed above and the ability to adjust the height of the straddle chair 12 relative to the floor 14 of the tub 10 gives the user the ability to direct water from the hydrotherapy system 38 to virtually any part of the body while the user is seated within the straddle chair 12. As discussed above, FIG. 1 shows the straddle seat 26 in a lowered position. FIG. 2 shows a hot tub similar to the hot tub of FIG. 1 with the straddle seat 26 of the straddle chair 12 in a raised position. The straddle seat 26 preferably attaches to the back support 24 at a variety of heights relative to the floor 14 of the tub 10 between the raised and lowered positions. The user can sit in any of the positions discussed above at any of the heights between and including the lowered position and the raised position.

The tub 10 preferably includes a pillow jet 50 for supporting the head of a user sitting in the straddle chair 12 in the first, second, third, or other positions. Exemplar pillow jets are disclosed in U.S. Pat. Nos. 5,333,324; 5,682,625; 5,716,333; 5,928,171; and 7,310,835, which are herein incorporated by reference in their entirety. The pillow jet 50 is operably disposed within a recess 52 in the upper portion 28 of the sidewall 18 above the top of the back support 24 and adjacent to the upper rim 20. The pillow jet 50 includes a pillow portion 54 that provides a soft surface for the user to rest the back of the head or the chin while reclining or leaning against the back support 24 of the straddle chair 12.

In addition to allowing for a hydrotherapy massage at various portions of a user's body, the straddle chair 12 also, by virtue of the wide array of sitting positions that it enables, facilitates the use of exercise equipment to work a variety of muscles in the user's body. In the preferred embodiment, a pair of grips 58 are mounted to the recess 52 for the user to grasp while seated in the straddle chair 12 (FIGS. 1 & 2). A pair of resilient bands 60 are mounted to the sidewall 18 in close proximity to the straddle seat 26. The user can utilize the resistance bands 60 and grips 58 while sitting in the straddle chair 12 at various heights in the first, second, third, or other positions to perform various resistance exercises and stretches.

Figure 3:
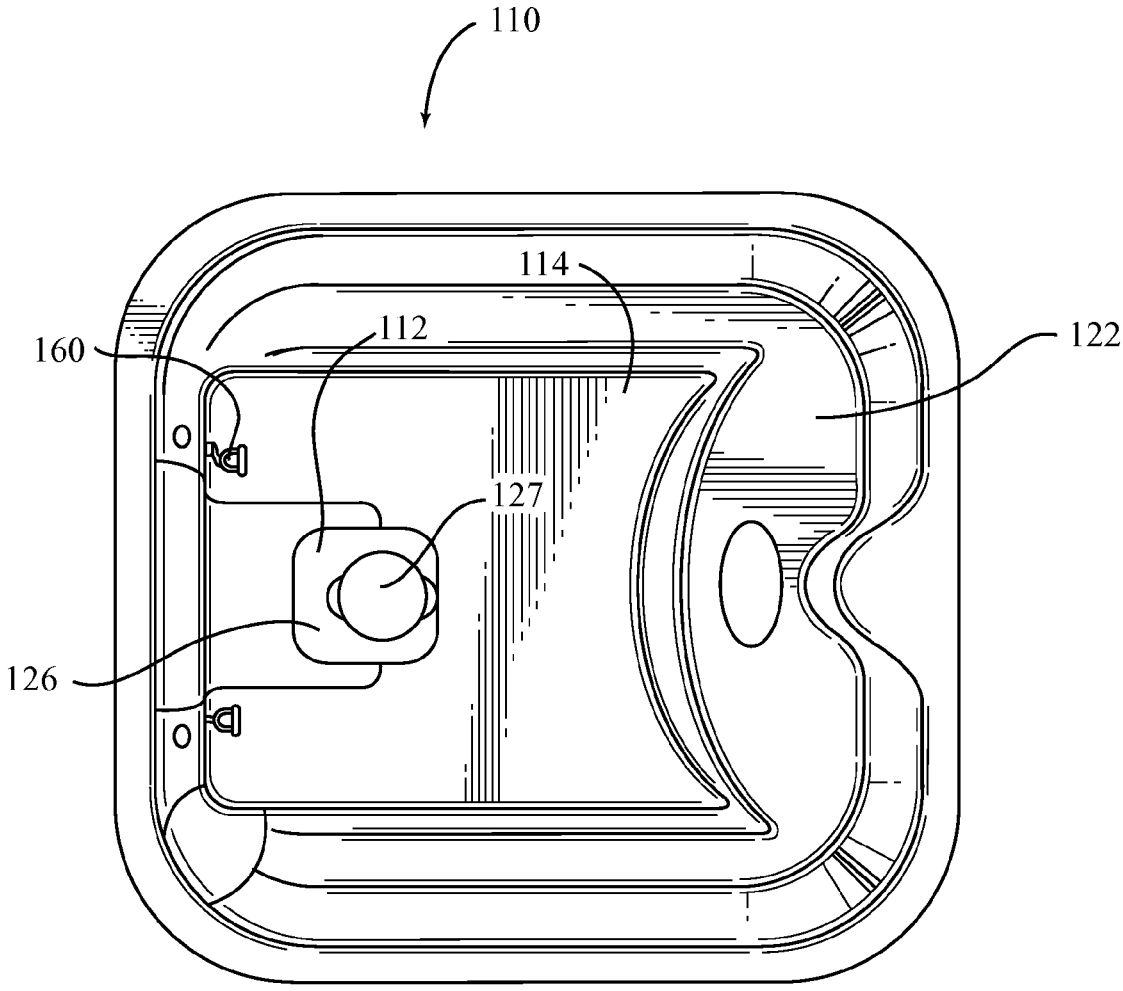
FIG. 3 is a top view of a second embodiment of the hot tub and straddle chair of the present invention in which the straddle seat of the straddle chair contains a swivel portion.

FIG. 3 shows a top view of a second embodiment of the tub 110 that is substantially similar to the tub 10 of FIG. 1 and FIG. 2. In this embodiment, the straddle seat 126 of the straddle chair 112 is equipped with a swivel portion 127 that rotates with the user relative to the floor 114. The swivel portion 127 may be used in conjunction with the pair of resilient bands 160 to perform exercises at various heights and positions in the straddle chair 112. In addition, depending on the length of the resilient bands 160, the user may optionally sit in any of the plurality of seats 122 in the tub 110 to perform the exercises.

Figure 4:
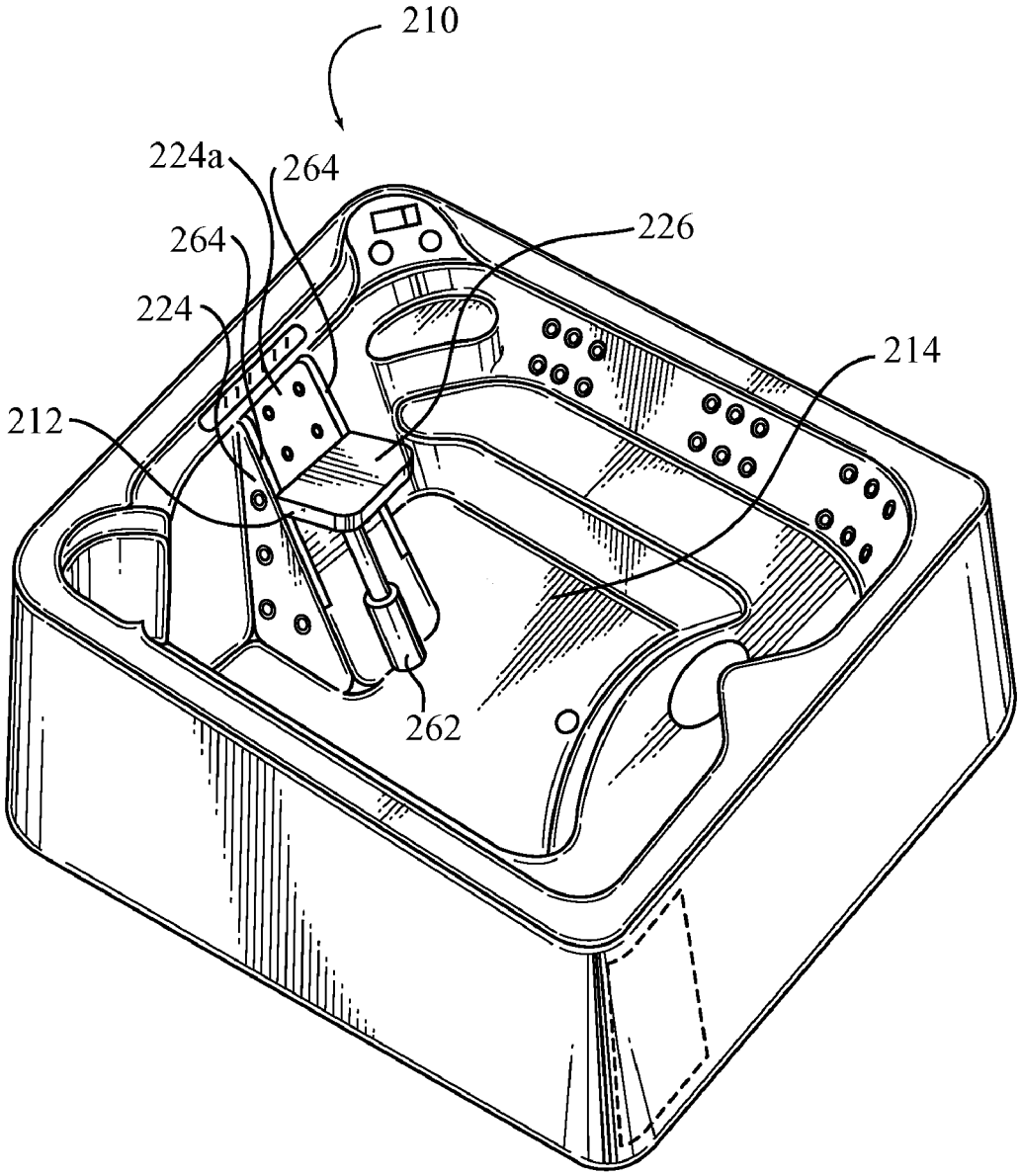
FIG. 4 is a perspective view of a third embodiment of the hot tub and straddle chair of the present invention in which a hydraulic lift is coupled to the straddle seat of the straddle chair.

FIG. 4 shows a perspective view of a third embodiment of the tub 210 that is substantially similar to the tub 10 of FIG. 1 and FIG. 2. In this embodiment, the straddle seat 226 of the straddle chair 212 may be adjustable in height relative to the floor 214 via a hydraulic system, pneumatic system, or other mechanized lift 262, which allows elderly or injured users to more easily enter and exit the tub. In such embodiments, the straddle seat 226 is preferably longitudinally displaceable along the front face 224*a* of the back support 224. Tracks 264 disposed at edges of the front face 224*a* may guide the straddle seat 226 as it is raised and lowered by the hydraulic system or mechanized lift 262. Other automated means known in the art for raising and lowering the straddle seat 226 may also be utilized.

Note that in embodiments in which the straddle seat 26 is adjustable in height relative to the floor 14 and in which the front face 24*a* slopes downward at an angle from the sidewall 18 to the floor 14 (FIGS. 1, 2, 4), as the straddle seat 26 is raised relative to the floor 14, the distance between the front face 48 of the straddle seat 26 and the opposing portion 34 of the tub 10 increases, which increases the amount of space on the floor 14 of the tub 10 when multiple users are seated therein. At higher heights, the straddle seat 26 orients the user's legs vertically, which takes up less floor space.

Figure 5:
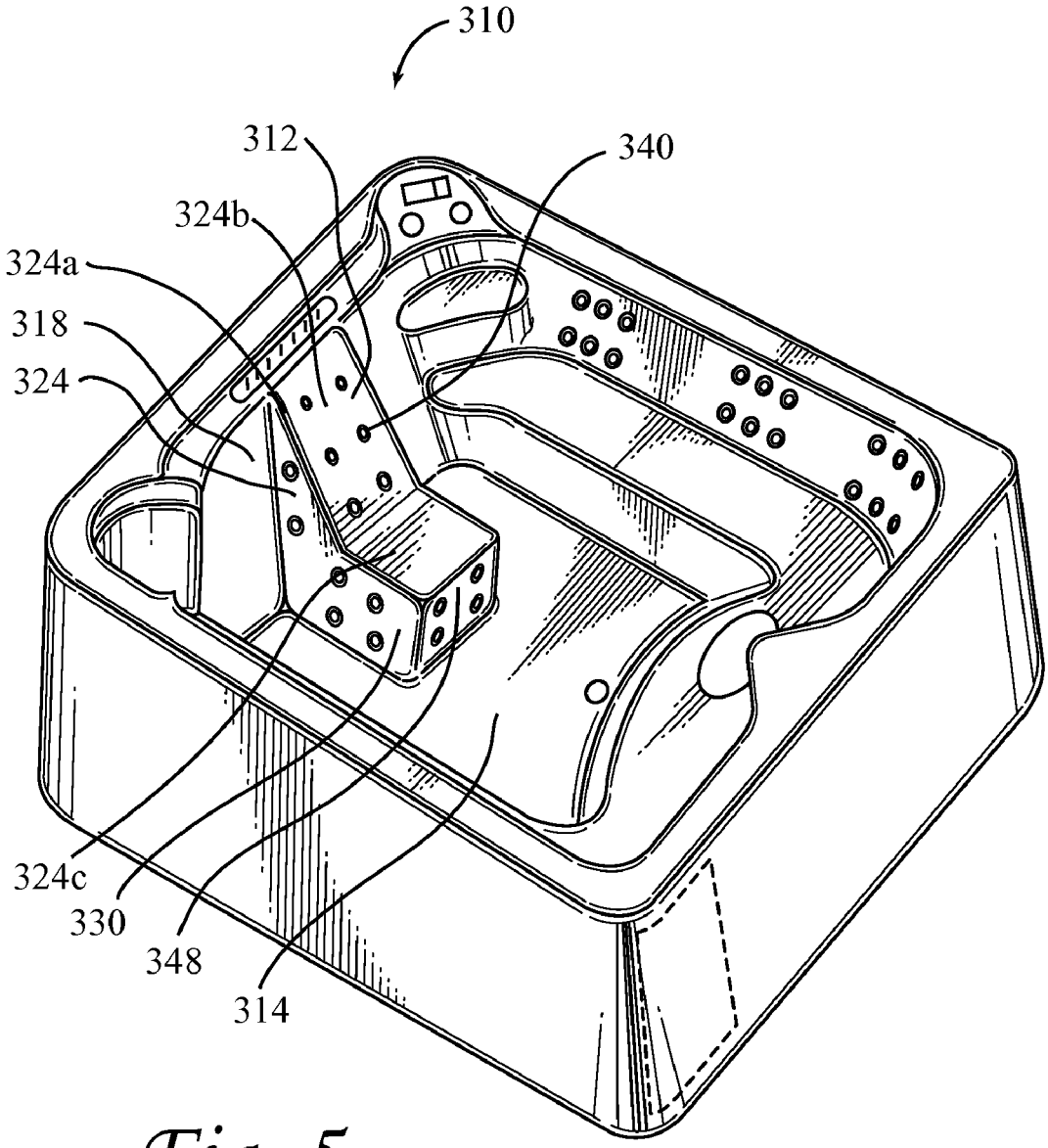
FIG. 5 is a perspective view of a fourth embodiment of the hot tub and straddle chair of the present invention in which the straddle seat of the straddle chair is integrally formed with the back support and sidewall of the tub.

FIG. 5 shows a perspective view of a fourth embodiment of the tub 310 that is substantially similar to the tub 10 of FIG. 1 and FIG. 2 except that both the back support 324 and a formed straddle seat 324*c* of the straddle chair 312 are integrally formed with the sidewall 318 of the tub 310. In this embodiment, the front face 324*a* of the back support 324 forms both a support surface 324*b* for supporting the user's back, chest, or side, and a formed straddle seat 324*c* on which the user may sit. The first plurality of jets 340 may be situated within the support surface 324*b*, the opposing side surfaces 330, and the front face 348 such that users can receive a water massage on their back, chest, and/or legs depending on their sitting position in the straddle chair 312. As in the above embodiments, an adjustable straddle seat that is adjustable relative to the floor 314 of the tub 310 may optionally be separately attached to the support surface 324*b* of the front face 324*a* above the formed straddle seat 324*c*. In other embodiments, a two piece mold may be used to create the tub 310 with floor space under the formed straddle seat 324*c*.

Figure 6:
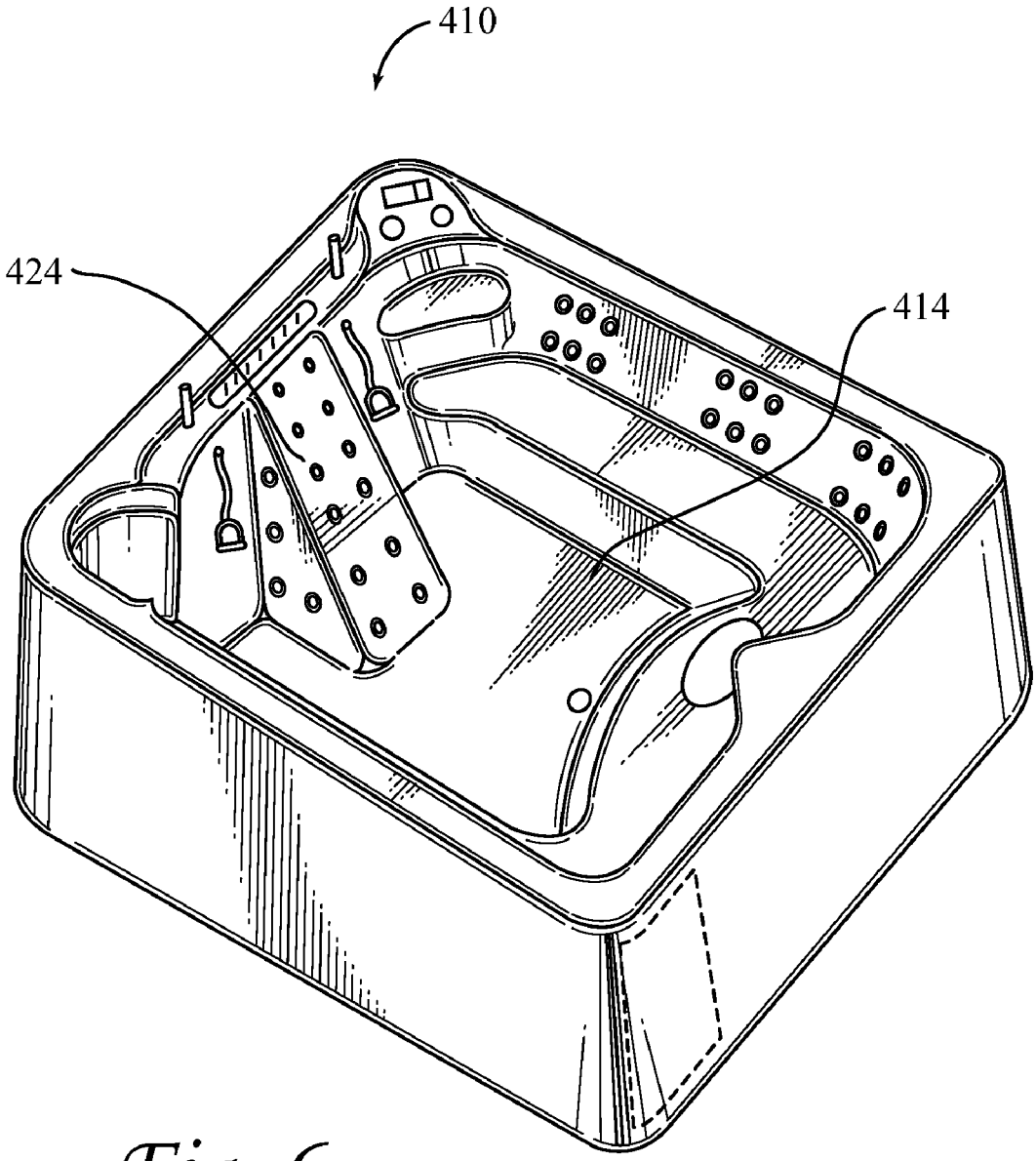
FIG. 6 is a perspective view of a hot tub similar to the hot tub of FIG. 1 without the straddle seat of the straddle chair.

FIG. 6 shows a perspective view of a fifth embodiment of the tub 410 that is substantially similar to the tub 10 of FIG. 1 and FIG. 2 except that the back support 424 is utilized without a straddle seat. This embodiment allows the user to kneel on the floor 414 of the tub 410 while leaning forward with the user's chest against the back support 424. The back support 424 may be manufactured with or without a means for attaching a straddle seat as the latter is optional and may be a later step in manufacturing or assembly.

There have been described and illustrated herein several embodiments of a hot tub and straddle chair apparatus. While particular embodiments of the invention have been described, it is not intended that the invention be limited thereto, as it is intended that the invention be as broad in scope as the art will allow and that the specification be read likewise. Thus, while embodiments of a straddle chair with a specifically shaped back support and straddle seat have been disclosed, it will be appreciated that other shapes may be used as well. In addition, while a back support extending from the upper portion of the sidewall of the tub to the floor of the tub has been disclosed, it will be appreciated that other back supports that do not extend to the upper portion of the sidewall or to the floor may be used. Moreover, while a particular seating configuration has been disclosed containing a straddle chair and a plurality of seating around the tub, it will be appreciated that other seating configurations in the hot tub may be used. In addition, while ranges for angles $\alpha$, $\beta$, $\lambda$ for the back support and the backs of seats around the tub have been disclosed, and while a relationship between $\alpha$ and $\lambda$ has also been disclosed, it will be appreciated that other angles may be used, and that these angles, as well as the relationships between them, may vary. It will therefore be appreciated by those skilled in the art that yet other modifications could be made to the provided invention without deviating from its spirit and scope as claimed.

What is claimed is:

1. A hot tub, comprising:

a tub including a floor, an interior, a sidewall projecting upward relative to said floor, an upper rim disposed above said sidewall, and a plurality of seats disposed in said tub along said sidewall, said sidewall having an upper portion adjacent to said upper rim;

a body support including a support surface oriented at an angle and extending from said upper portion of said sidewall to a lower end at said floor, and two opposing side surfaces bounded by said floor, said support surface, and said sidewall such that said support surface and said two opposing side surfaces of said body support together form an outer periphery of said body support such that the body support is completely spaced apart from each of said plurality of seats by said floor about said outer periphery and said lower end of said support surface is spaced apart from said sidewall of said tub; and a hydrotherapy system for circulating and pressurizing water, said hydrotherapy system including a first plurality of jets situated within said body support, a water pump for circulating the water through said first plurality of jets toward the interior of said tub, and a suction return to said pump.

2. The hot tub of claim 1, wherein:

said support surface is generally planar.

3. The hot tub of claim 1, wherein:

said support surface slopes at a constant angle from said upper portion of said sidewall to said floor.

4. The hot tub of claim 1, wherein:

said opposing side surfaces are at least five inches from any of said plurality of seats, and said support surface is at least ten inches from said sidewall at said floor.

5. The hot tub of claim 1, wherein:

said outer periphery of said body support is bounded by said floor on at least three sides at said floor.

6. The hot tub of claim 1, further comprising:

a second plurality of jets mounted to said opposing side surfaces of said body support, said second plurality of jets directing water toward the interior of said tub.

7. The hot tub of claim 1, further comprising:

a pillow jet mounted to said upper portion of said sidewall above said body support.

8. The hot tub of claim 1, wherein:

said sidewall is integrally formed with said floor, and said plurality of seats and said upper rim are integrally formed with said sidewall.

9. The hot tub of claim 1, wherein:

said support surface defines a straddle chair above said floor, said straddle chair having a seat portion and a back portion extending upward relative to said seat portion, said back portion and said seat portion being integrally formed with said support surface, whereby a user may sit on said seat portion and lean against said back portion.

10. The hot tub of claim 1, further comprising:

a straddle seat mounted to and projecting outward from said body support whereby said body support and said straddle seat together form a straddle chair in which a user may sit and receive a water massage from said hydrotherapy system.

11. The hot tub of claim 10, wherein:

said straddle seat includes a swivel portion that rotates with the user relative to said floor.

12. A hot tub for use by a user having a head, a back, a chest, two sides between the back and the chest, a waist, a pair of legs, each leg having a thigh, and a pair of feet, said hot tub comprising:

a tub including a floor, an interior, a sidewall projecting upward relative to said floor, an upper rim disposed above said sidewall, and a plurality of seats disposed in said tub along said sidewall, said sidewall having an upper portion adjacent to said upper rim;

a straddle chair having a back support and a straddle seat, said back support protruding outward from said sidewall and having a front face, said straddle seat being mounted to and projecting outward from said front face so as to permit the user to sit in said straddle chair in a first position with the user's back against said back support and the user's legs extending past said front face of said straddle seat toward the interior of said tub, in a second position with the user's chest against said back support and the user's legs straddling said back support with the user's thighs extending toward said sidewall, and in a third position with one of the user's two sides against said back support and the user's thighs extending substantially parallel with said sidewall; and a hydrotherapy system for circulating and pressurizing water, said hydrotherapy system including a first plurality of jets situated within said back support, a water pump for circulating the water through said first plurality of jets toward the interior of said tub, and a suction return to said pump.

13. The hot tub of claim 12, wherein:

said straddle seat of said straddle chair is surrounded by said floor on at least three sides of said straddle seat such that the user may place feet on said floor while sitting in each of said first position, said second position, and said third position.

14. The hot tub of claim 13, wherein:

said back support of said straddle chair extends down to said floor and is surrounded by said floor on at least three sides.

15. The hot tub of claim 12, wherein:

said straddle seat rotates relative to said floor such that a user may rotate from one of said first, second, and third positions to another of said first, second, and third positions.

16. The hot tub of claim 12, wherein:

said sidewall is integrally formed with said floor, and said plurality of seats and said upper rim are integrally formed with said sidewall.

17. The hot tub of claim 12, further comprising:

a pillow jet mounted to said upper portion of said sidewall above said back support, said pillow jet including a pillow portion for supporting the user's head and at least one jet.

18. The hot tub of claim 10, wherein:

said straddle seat is mounted to said body support in a cantilevered manner.

19. The hot tub of claim 12, wherein:

said straddle seat is mounted to said back support in a cantilevered manner.

20. The hot tub according to claim 10, wherein:

said straddle seat is an adjustable seat that can be adjusted in height relative to said floor.

21. The hot tub according to claim 12, wherein:

said straddle seat is an adjustable seat that can be adjusted in height relative to said floor.

* * * * *